US009244435B2

(12) United States Patent
Tako et al.

(10) Patent No.: US 9,244,435 B2
(45) Date of Patent: Jan. 26, 2016

(54) TIMEPIECE HAVING A WIDE VARIETY OF APPEARANCES

(71) Applicant: SEIKO CLOCK INC., Tokyo (JP)

(72) Inventors: Motohiro Tako, Tokyo (JP); Toyonori Muraji, Tokyo (JP); Hiroshi Takematsu, Tokyo (JP)

(73) Assignee: SEIKO CLOCK INC., Tokyo (JP)

( * ) Notice: Subject to any disclaimer, the term of this patent is extended or adjusted under 35 U.S.C. 154(b) by 0 days.

(21) Appl. No.: 14/267,218

(22) Filed: May 1, 2014

(65) Prior Publication Data

US 2014/0334273 A1 Nov. 13, 2014

(30) Foreign Application Priority Data

May 9, 2013 (JP) ..... 2013-099250

(51) Int. Cl.
*G04B 45/00* (2006.01)
*G04B 25/06* (2006.01)

(52) U.S. Cl.
CPC ..... *G04B 45/0038* (2013.01); *G04B 25/06* (2013.01); *G04B 45/00* (2013.01)

(58) Field of Classification Search
CPC ..... G04B 45/00; G04B 45/0023; G04B 45/0038; G04B 25/06; G04B 47/044
USPC ..... 368/75, 267, 269, 272, 273
See application file for complete search history.

(56) References Cited

U.S. PATENT DOCUMENTS

| | | | | |
|---|---|---|---|---|
| 4,941,137 | A * | 7/1990 | Kikuchi | 368/223 |
| 5,047,998 | A * | 9/1991 | Aizawa et al. | 368/75 |
| 5,161,130 | A * | 11/1992 | Sato et al. | 368/228 |
| 5,438,154 | A * | 8/1995 | Segan et al. | 84/600 |
| 5,825,721 | A * | 10/1998 | Miyane | 368/10 |
| 5,864,519 | A * | 1/1999 | Nakamura | 368/10 |
| 6,229,768 | B1 * | 5/2001 | Nakazawa et al. | 368/223 |
| 2005/0259522 | A1 * | 11/2005 | Takiguchi | 368/285 |
| 2007/0277578 | A1 * | 12/2007 | Muraji | 72/354.2 |
| 2007/0280055 | A1 * | 12/2007 | Muraji | 368/223 |
| 2008/0239884 | A1 | 10/2008 | Muraji | |
| 2009/0097362 | A1 * | 4/2009 | Subilia et al. | 368/206 |
| 2011/0019507 | A1 * | 1/2011 | Muraji | 368/220 |
| 2013/0028057 | A1 * | 1/2013 | Nagatake et al. | 368/228 |

FOREIGN PATENT DOCUMENTS

JP 2008-249643 A1 10/2008

OTHER PUBLICATIONS

U.S. Office Action dated May 13, 2015 issued in related U.S. Appl. No. 14/267,203.

* cited by examiner

*Primary Examiner* — Amy Cohen Johnson
*Assistant Examiner* — Matthew Powell
(74) *Attorney, Agent, or Firm* — Kratz, Quintos & Hanson, LLP

(57) ABSTRACT

A timepiece, which includes an ornamental body; a drive mechanism that moves the ornamental body; an output portion that outputs a sound; and a control portion that performs movement control for outputting a piece of theme music and moving the ornamental body from an initial position. The control portion further performs return control for outputting a piece of ending music and moving the ornamental body to the initial position after the movement control is finished. Under the return control, the outputted and selected pieces of ending music have different lengths depending on whether or not a position of the ornamental body is in front of a reference position. It is thus possible to design the movement pattern of the ornamental body under the movement control, without consideration of the stop positions of the ornamental body at the end of the movement control period; thereby, allowing for a wide variety of appearances for the timepiece.

4 Claims, 11 Drawing Sheets

FIG. 10A

| | |
|---|---|
| FIRST PIECE OF THEME MUSIC | FIRST MOVEMENT PATTERN |
| SECOND PIECE OF THEME MUSIC | SECOND MOVEMENT PATTERN |
| THIRD PIECE OF THEME MUSIC | THIRD MOVEMENT PATTERN |
| FOURTH PIECE OF THEME MUSIC | FOURTH MOVEMENT PATTERN |
| FIFTH PIECE OF THEME MUSIC | FIFTH MOVEMENT PATTERN |
| SIXTH PIECE OF THEME MUSIC | SIXTH MOVEMENT PATTERN |

FIG. 10B

| | |
|---|---|
| FIRST PIECE OF ENDING MUSIC | REVERSE ROTATION PATTERN |
| SECOND PIECE OF ENDING MUSIC | |

TIMEPIECE HAVING A WIDE VARIETY OF APPEARANCES

CROSS-REFERENCE TO RELATED APPLICATION

This application is based upon and claims priority to Japanese Patent Application No. 2013-099250 filed on May 9, 2013, subject matter of this patent document is incorporated by reference herein in its entirety.

BACKGROUND (i) Technical Field

The present invention relates to timepieces.

(ii) Related Art

There is a timepiece performing movement control for outputting a piece of theme music and moving an ornamental body from an initial position, and performing return control for outputting a piece of ending music and returning the ornamental body to the initial position. Such a timepiece is disclosed in Japanese Patent Application Publication No. 2008-249643.

SUMMARY

It is an object of the present invention to provide a timepiece with a wide variety of appearances.

According to an aspect of the present invention, there is provided a timepiece including: an ornamental body; a drive mechanism moving the ornamental body; an output portion capable of outputting a sound; and a control portion performing movement control for outputting a piece of theme music and moving the ornamental body from an initial position, and performing return control for outputting a piece of ending music and moving the ornamental body to the initial position after the movement control is finished, wherein plural types of pieces of theme music capable of being output from the output portion are respectively associated with plural types of movement patterns of the ornamental body, under the movement control, a piece of theme music selected from the plural types of pieces of theme music is output, and the ornamental body is moved based on a movement pattern associated, with the selected piece of theme music, and under the return control, a piece of ending music is output and selected from plural pieces of ending music having different lengths, depending on whether or not a stop position of the ornamental body at the end of the movement control is in front of a reference position.

BRIEF DESCRIPTION OF THE DRAWINGS

FIG. 10A is a schematic view of pieces of theme music to be output and movement patterns for ornamental bodies under movement control;

FIG. 10B is a schematic view of pieces of ending music and movement patterns for ornamental bodies under return control.

DETAILED DESCRIPTION

Figure 1:
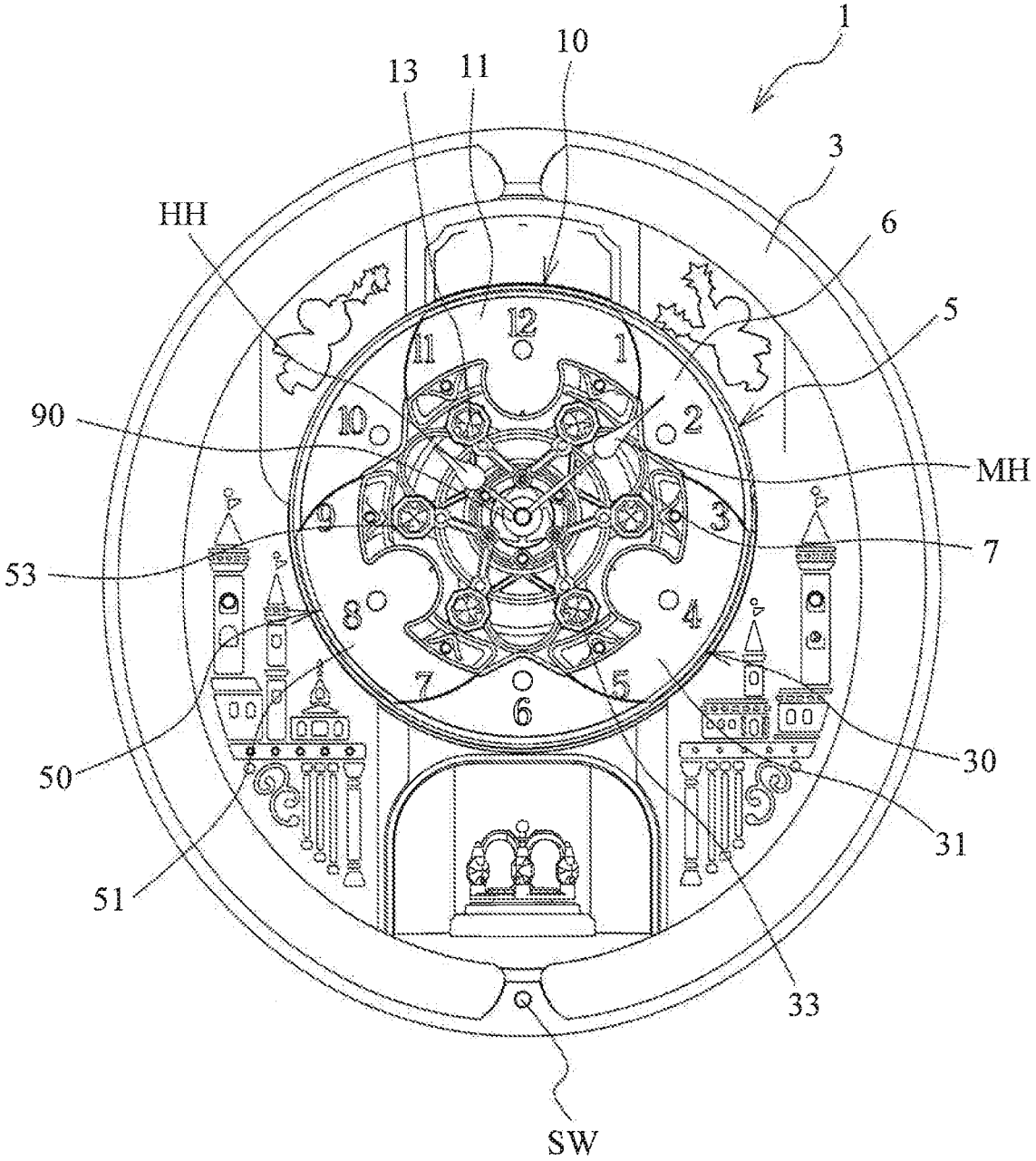
FIG. 1 is a front view of a timepiece.

FIG. 1 is a front view of a timepiece 1. The timepiece 1 includes: a front board 3 to which decoration is applied; an ornamental board 5 rotatably arranged within an opening formed at a substantial center of the front board 3; and ornamental bodies 10, 30, and 50 movably arranged in a front side of the ornamental board 5. Also, the timepiece 1 includes: a minute hand MH and a hour hand HH showing the time; and a securing member 90 for protecting rotational shafts coupled therewith. The securing member 90 is located at a substantial center of the timepiece 1. A monitor switch SW is provided at the lower side of the front board 3. FIG. 1 illustrates the state where the ornamental board 5, the ornamental body 10, and the like stop at respective initial positions.

The ornamental board 5 has a substantial round shape and includes: a board portion 6 on which numbers for indicating the time are denoted; and an ornamental portion 7 to which decoration is applied and which is positioned closer to the center than the board portion 6. On the board portion 6, the numbers "2", "6", and "10" are denoted at equal angular intervals. The ornamental portion 7 is formed with plural rod-shaped portions that are curved.

The ornamental body 10 includes: a board portion 11 on which numbers are denoted; and an ornamental portion 13 formed to extend to the securing member 90 from the board portion 11. The ornamental portion 13 is formed with plural rod-shaped portions, some of which are straight and the other of which are curved. Likewise, the ornamental bodies 30 and 50 respectively include board portions 31 and 51, and ornamental portions 33 and 53. The numbers "11", "12", and "1" are denoted on the board portion 11. The numbers "3", "4", and "5" are denoted on the board portion 31. The numbers "7", "8", and "9" are denoted on the board portion 51. In an initial state illustrated in FIG. 1, the ornamental bodies 10, 30, and 50 are arranged to expose the numbers denoted on the ornamental board 5, the ornamental board 5 and the ornamental bodies 10, 30, and 50 are maintained in a round shape as a whole, and these members function as a single dial plate as a whole.

Figure 2:
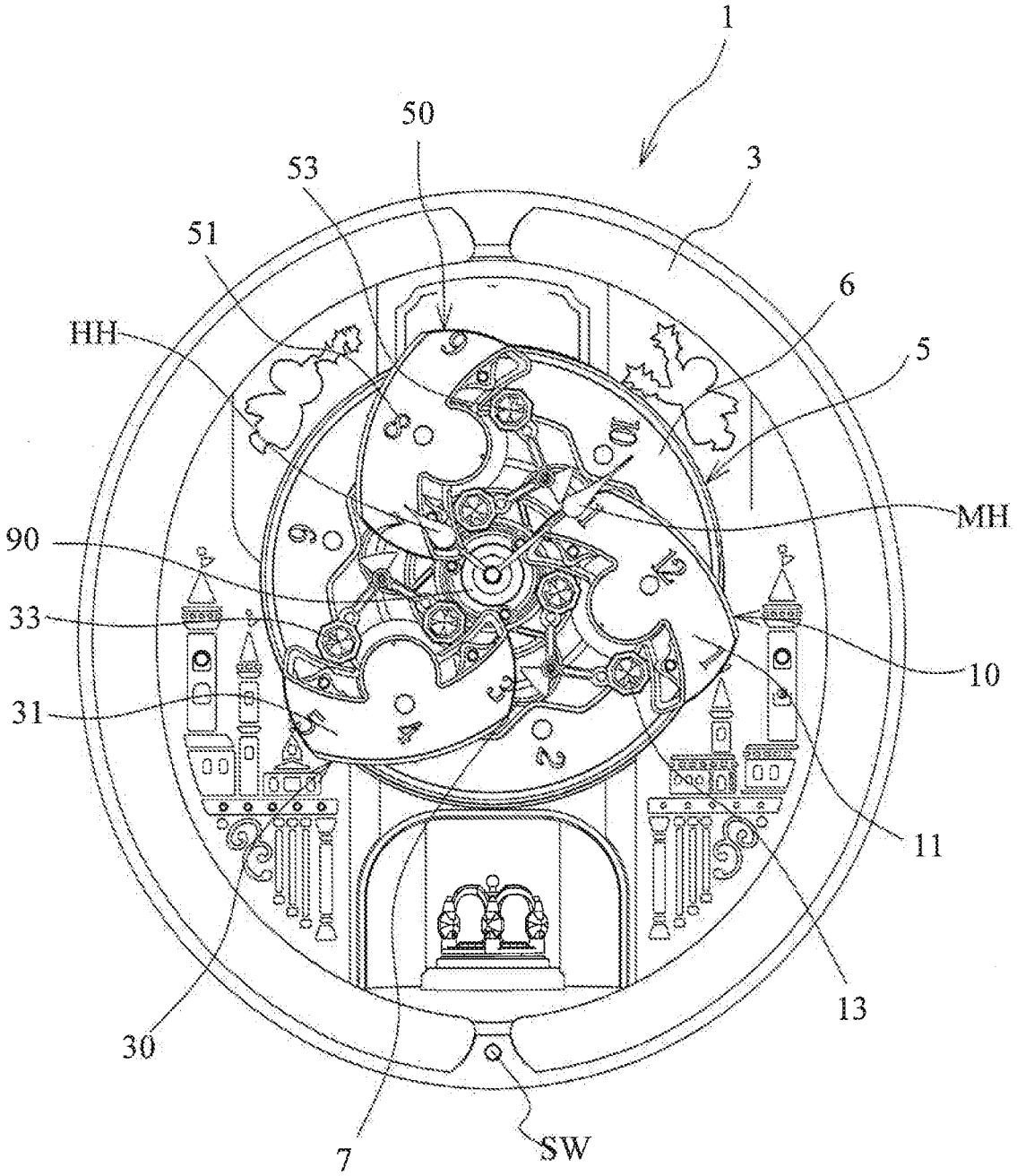
FIG. 2 is a front view of the timepiece.

When a predetermined time has come, or when the monitor switch SW is pushed as will be described later, the timepiece 1 starts the performance operation. Specifically, movement control is performed to move the ornamental board 5, the ornamental body 10, and the like from the respective initial positions. The ornamental board 5 rotates about the securing member 90 from the initial state illustrated in FIG. 1 and the ornamental bodies 10, 30, and 50 rotate while revolving about the securing member 90 as illustrated in FIG. 2. Specifically, the ornamental board 5 rotates clockwise from the initial state, and the ornamental bodies 10, 30, and 50 rotate clockwise while revolving clockwise about the rotational center of the ornamental board 5.

Figure 3:
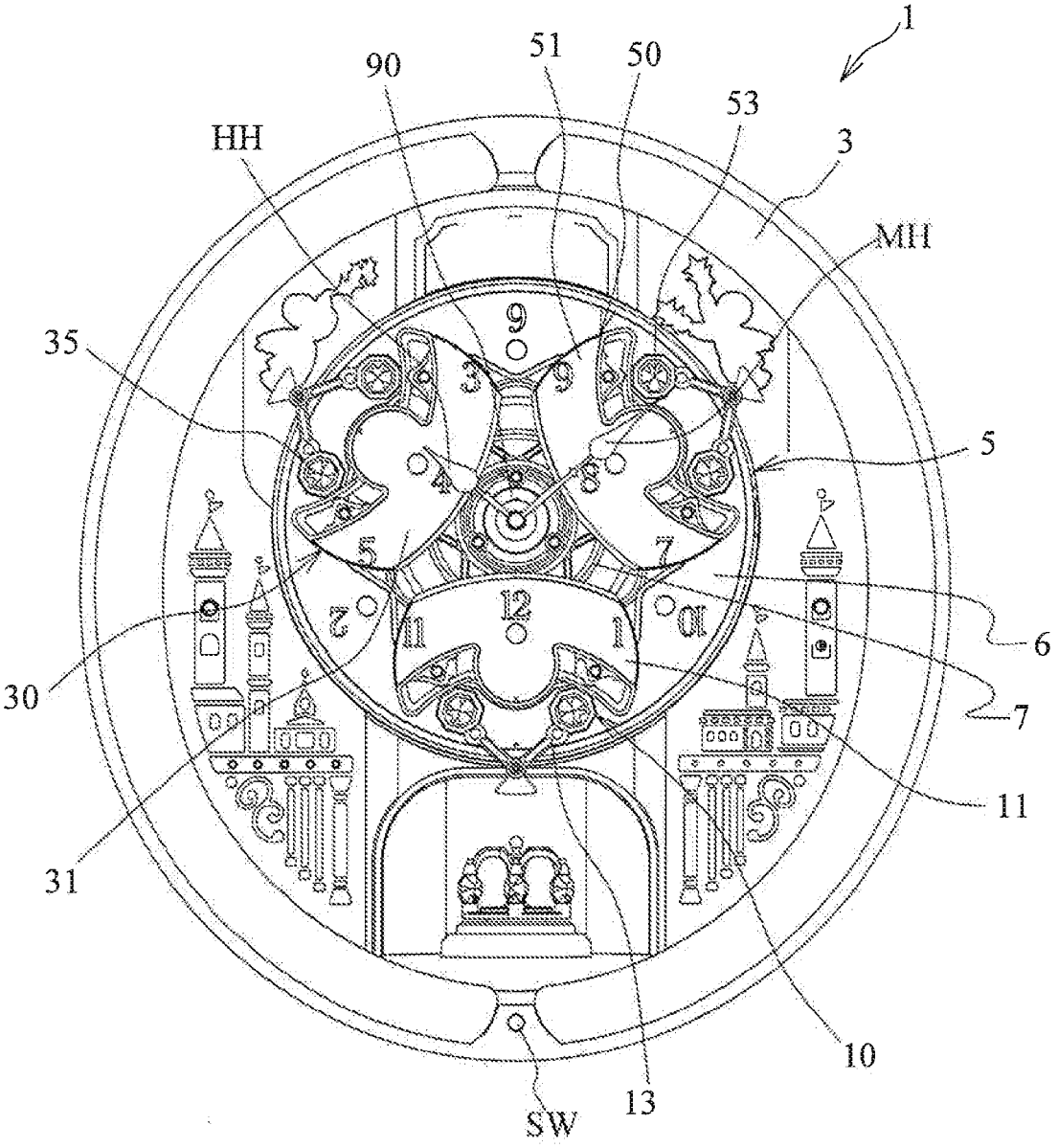
FIG. 3 is a front view of the timepiece.
Figure 4:
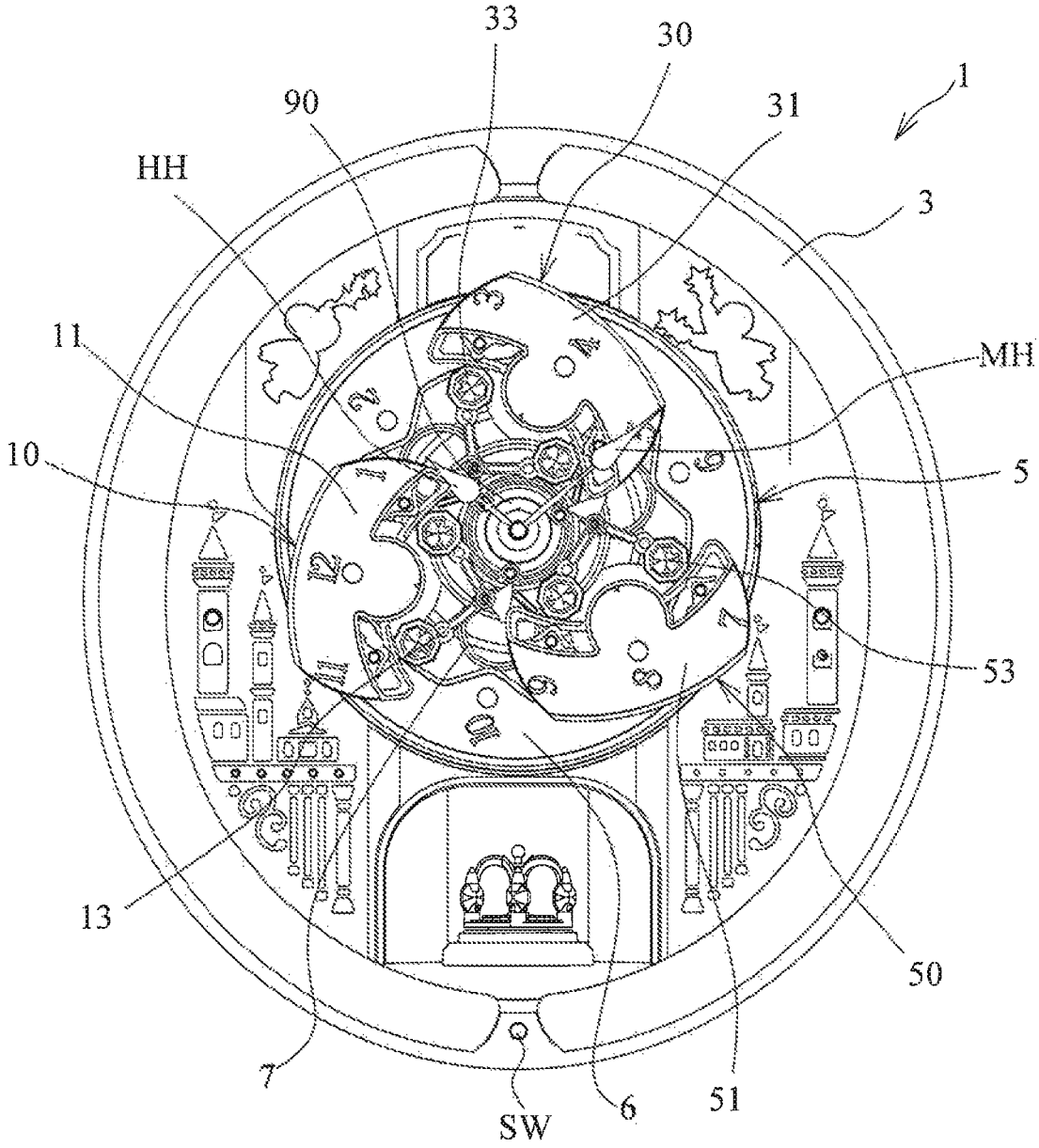
FIG. 4 is a front view of the timepiece.

FIG. 3 illustrates the ornamental body 10 and the like positioned at respective reference positions. FIG. 4 illustrates the ornamental body 10 and the like positioned beyond the respective reference positions. Under the movement control, a piece of theme music is output from a speaker not illustrated. In addition, under the movement control, the ornamental board 5 rotates clockwise from the initial state, stops in the part way, or rotates reversely, so that the ornamental board 5 as a whole finally rotates clockwise. When the ornamental board 5 rotates counterclockwise, the ornamental bodies 10, 30, and 50 revolve and rotate counterclockwise. In the timepiece 1, the ornamental board 5 rotates, and the ornamental bodies 10, 30, and 50 revolve and rotate in such a way. This presents a wide variety of appearances.

When the movement control is finished, return control is performed to rotate the ornamental body 10 and the like counterclockwise to the respect initial positions. Under the return control, the speaker outputs a piece of ending music different from the piece of theme music. Further, under the return control, the ornamental body 5 rotates counterclockwise with a constant speed, and the ornamental body 10 and the like rotate and return to the respective initial positions while revolving counterclockwise about the securing member 90.

Figure 5:
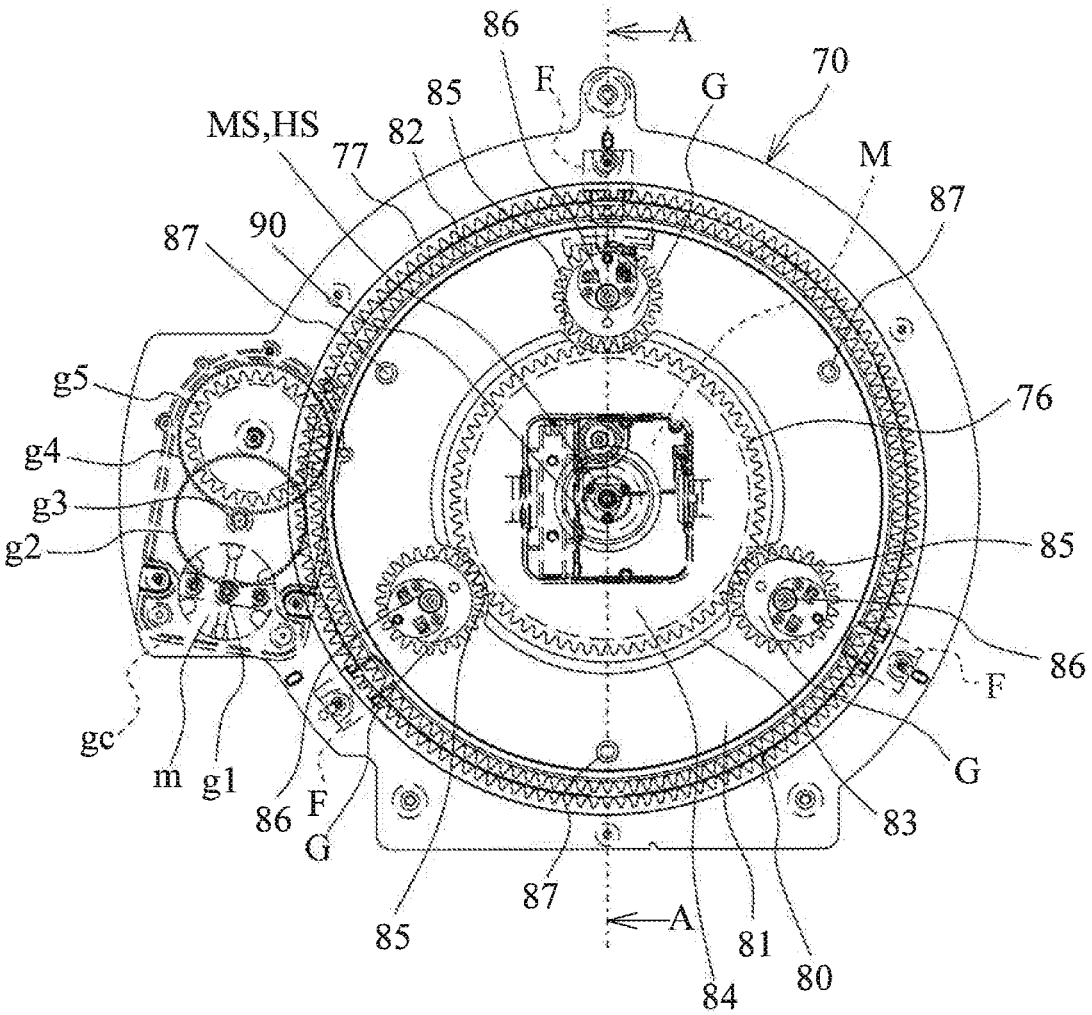
FIG. 5 is an explanatory view of a drive mechanism of the timepiece.
Figure 6:
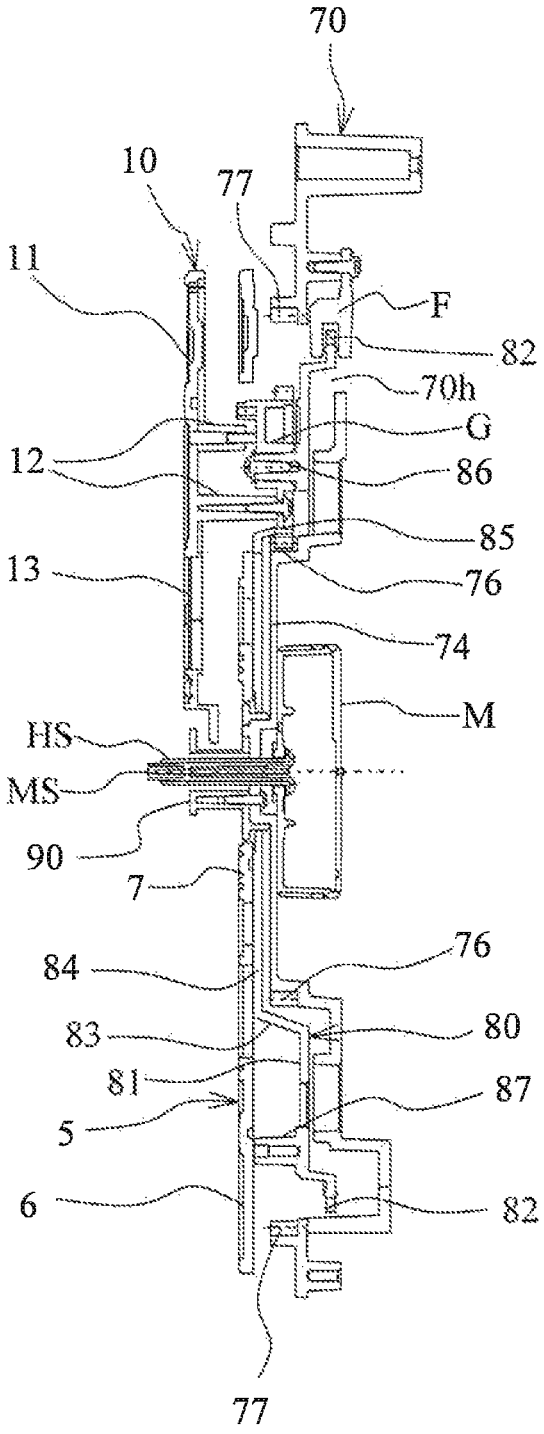
FIG. 6 is a sectional view taken along line A-A of FIG. 5.

FIG. 5 is an explanatory view of a drive mechanism of the timepiece 1. FIG. 6 is a sectional view taken along line A-A of FIG. 5. Additionally, although FIG. 5 does not illustrate the ornamental board 5 or the ornamental bodies 10, 30, and 50, FIG. 6 illustrates the ornamental board 5 and the ornamental body 10. A base board 70 is arranged in a rear side of the front board 3. In the rear side of the base board 70, a movement M is provided for moving the minute hand MK and the hour hand HH, and a gear case gc that houses a motor m and the like is provided for driving the ornamental board 5, the ornamental body 10, and the like. In the front side of the base board 70, a rotary board 80 is arranged for rotation relative to the base board 70. The rotary board 80 rotates about the securing member 90. The rotary board 80 is rotated by the motor m, and in response to this, the ornamental board 5 rotates, and the ornamental body 10 and the like rotate while revolving. The base board 70, the rotary board 80, the gear case gc, the motor m, and the like correspond to a drive mechanism for moving the ornamental board 5, the ornamental body 10, and the like.

Within the gear case gc, there are arranged the motor m, a gear g2 meshing with a gear g1 of the motor m, a gear g3 coaxially secured to the gear g2 and having a pitch diameter smaller than that of the gear g2, a gear g4 meshing with the gear g3, and a gear g5 coaxially secured to the gear g4 and having a pitch diameter smaller than that of the gear g4. The rotational drive force of the motor m is reduced and transmitted to the gear g5.

The gear g5 engages a teeth portion 82 formed in an outer circumferential edge of the rotary board 80. Therefore, the rotary board 30 rotates relative to the base board 70. Also, the teeth portion 82 is formed into a circular shape about the rotational center of the rotary board 80. The rotary board 80 has a substantially round shape, and the outer circumferential edge portion thereof is sandwiched by three holding members F. The holding members F are secured to the rear side of the base board 70. The base board 70 is formed with a notch 70*h* for receiving the outer circumferential portion of the rotary board 80. The outer circumferential portion of the rotary board 80 are supported by the holding members F through the notch 70*h*. Also, the rotary board 80 is supported by the holding members F so as to be slightly spaced from the base board 70 in the forward direction.

The rotary board 80 is provided with the teeth portion 82, an outer side portion 81, an inclined portion 83, and an inner side portion 84, in this order from the radially outer side to the radially inner side. The inclined portion 83 extends toward the front side from the outer side portion 81. The inner side portion 84 is located in the front side of the outer side portion 81. The inner side portion 84 and the outer side portion 81 are substantially parallel to each other. The ornamental board 5 is secured to the inner side portion 84. The outer side portion 81 is located in the front side of the base board 70 and has a substantially planar shape. The outer side portion 81 is provided with three spindle portions 86; and three spindle portions 87 that are more distant from the rotational center of the rotary board 80 than the spindle portions 86. The three spindle portions 86 are the same in distance from the rotational center of the rotary board 80. The three spindle portions 87 also have a similar arrangement. The three spindle portions 86 are positioned at even angular intervals, specifically, at 120 degree-intervals. The three spindle portions 87 also have a similar arrangement. The spindle portions 86 and 87 are adjacent to one another. The angular interval between the adjacent spindle portions 86 and 87 is the same as that between other adjacent spindle portions 86 and 87. The angle between the adjacent spindle portions 86 and 87 is 60 degrees.

The three spindle portions 86 support respective gears G for rotation. Although the three spindle portions 87 do not support the gears G, the three spindle portions 87 are capable of supporting the respective gears G. The three gears G are secured to the respective ornamental bodies 10, 30, and 50 mentioned above. As illustrated in FIG. 6, the gear G is secured to plural secured spindles 12 extending from the rear side of the ornamental body 10. The other ornamental bodies 30 and 50 have the same arrangement. The rotation of the rotary board 80 permits the three gears G to revolve about the rotational center of the rotary board 80. Also, in response to this, the three gears G mesh with an outer teeth portion 76 of the base board 70.

The outer teeth portion 76 is formed into a round shape about the rotational center of the rotary board 80. The inclined portion 83 of the rotary board 80 is formed to surround the outer teeth portion 76 of the base board 70, and is partially formed with cutout portions 85 for exposing the outer teeth portion 76 of the base board 70. The gears G supported by the spindle portions 86 mesh with the outer teeth portion 76 of the base board 70 through the respective cutout portions 85. Thus, when the rotary board 80 rotates clockwise, the gears G mesh with the outer teeth portion 76 and rotate clockwise while revolving clockwise. Thus, the ornamental bodies 10, 30, and 50 secured to the respective these gears G rotate clockwise while revolving. Additionally, since the ornamental board 5 is secured to the rotary board 80, the ornamental board 5 rotates together with the rotary board 80.

The base board 70 is formed with an inner teeth portion 77 that is positioned outside the outer teeth portion 76 and that is concentrically formed therewith. The spindle portions 87 are provided to be closer to the inner teeth portion 77 than to the outer teeth portion 76. The spindle portions 86 are provided to be closer to the outer teeth portion 76 than to the inner teeth portion 77. For example, the gear G is supported by the spindle portion 87 to mesh with the inner tooth portion 77. Therefore, the rotary board 80 rotates clockwise, so that the gear G supported by the spindle portion 87 rotates counterclockwise while revolving clockwise. Such a gear G is secured with an ornamental body, so this makes it possible to easily manufacture a timepiece having an ornamental body different in movement from the timepiece 1 according to the present invention at a reduced cost.

Additionally, the securing member 30 surrounds rotational shafts MS and HS respectively connected with the minute hand MH and the hour hand HH, thereby preventing the ornamental body 10 from coming into contact with the rotational shafts MS and HS.

Figure 7:
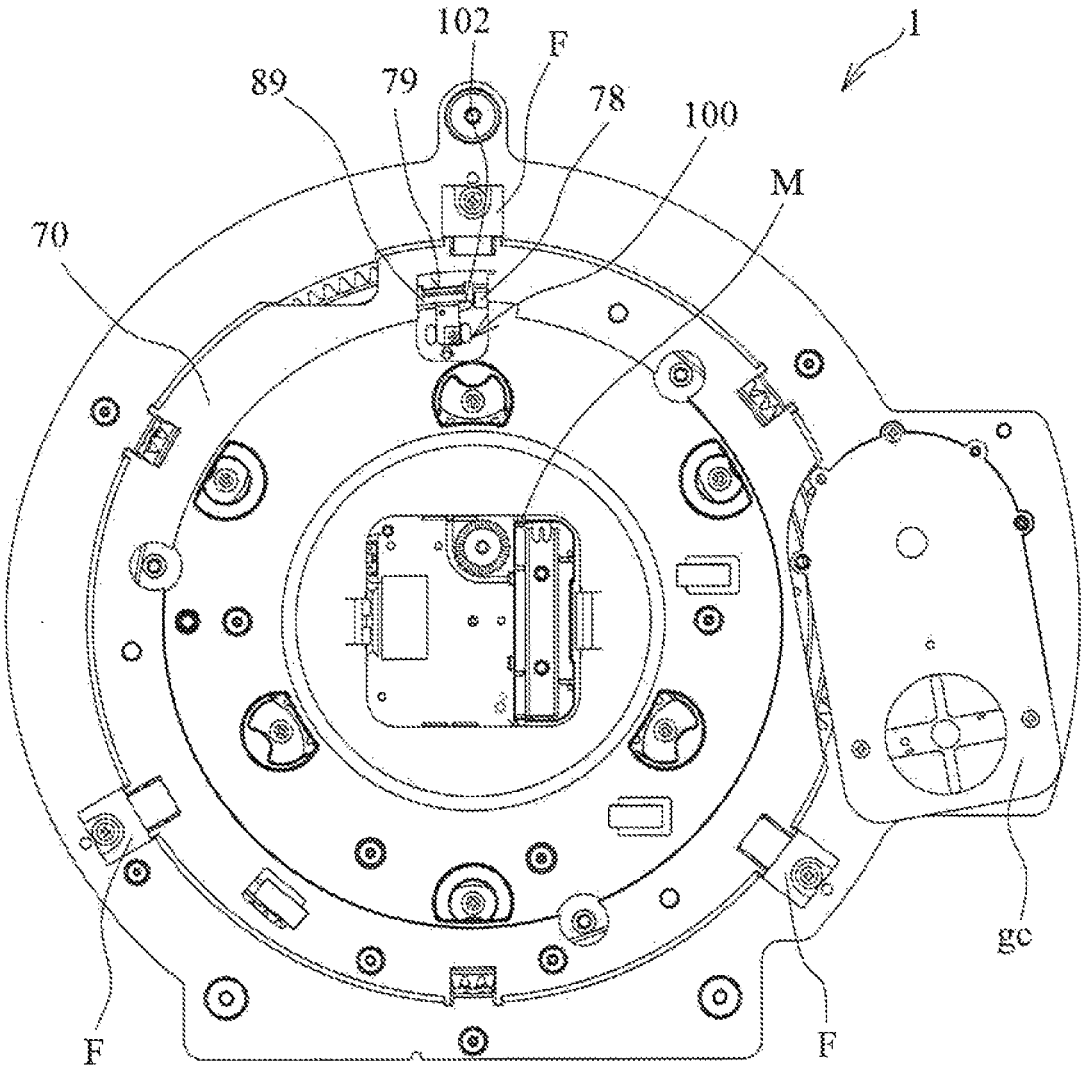
FIG. 7 is a rear view of the timepiece.

FIG. 7 is a rear view of the timepiece 1. An initial position detection switch 100 is secured to a rear side of the base board 70. A cutout 79 is formed in the base board 70 and partially exposes the rotary board 80 such that the initial position detection switch 100 faces the rotary board 80. The initial position detection switch 100 detects that the ornamental body 10 and the like are positioned at the respective initial positions.

Figure 8A:
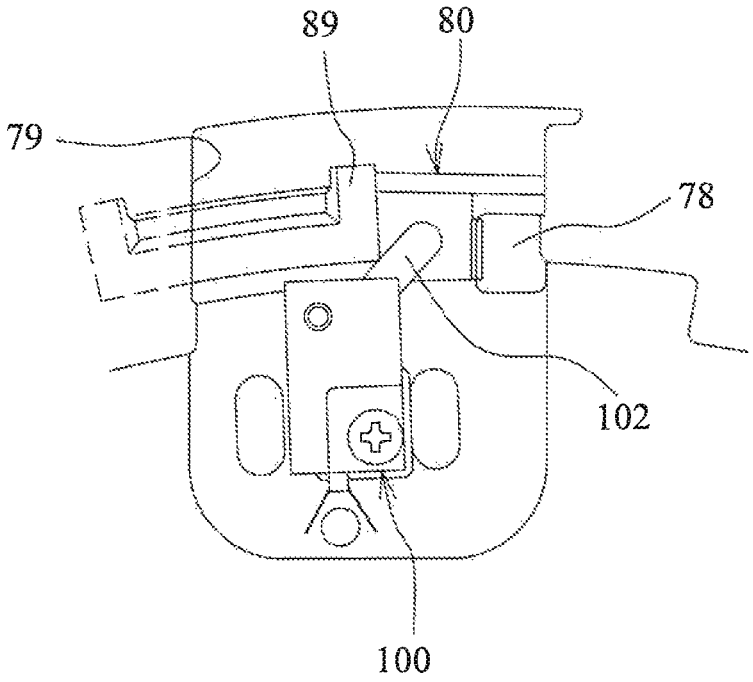
FIGS. 8A and 8B are enlarged views of an initial position detection switch.
Figure 8B:
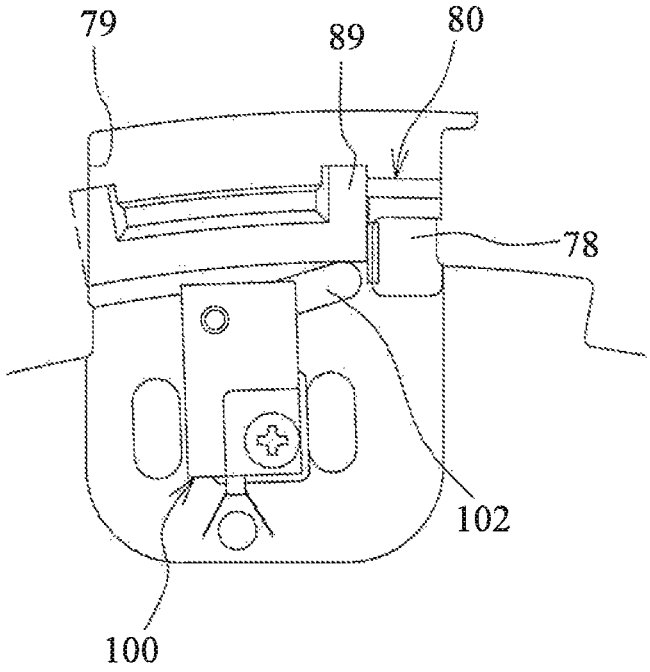

FIGS. 8A and 8B are enlarged views of the initial position detection switch 100. For example, when the ornamental body 10 and the like return to the initial position under the return control, a projection portion 83 formed in the rear side of the rotary board 80 pushes a lever 102 of the initial position detection switch 100. It is therefore detected that the ornamental body 10 and the like are positioned at the respective initial positions. At this time, the projection portion 89 also comes into contact with a stopper 73 formed in the base board 70. This restricts further rotation of the rotary board 80, so the rotary board 80 is positioned at the initial position. The stopper 78 is an example of a restriction portion. Under the return control, when the initial position detection switch 100 detects that the rotary board 80 is positioned at the initial position, the motor m stops.

As mentioned above, the base board 70 is formed with the stopper 78 with which the rotary board 80 comes into contact at the initial position. Thus, when the timepiece 1 is viewed from its front side, the rotary board 80 is capable of rotating only by substantially one rotation from the initial position. That is, the rotational range of the rotary board 80 is limited to one rotation. Additionally, under the movement control, the rotary board 80 starts rotating from the initial position, so the projection portion 89 moves away from the lever 102 of the initial position detection switch 100.

Figure 9:
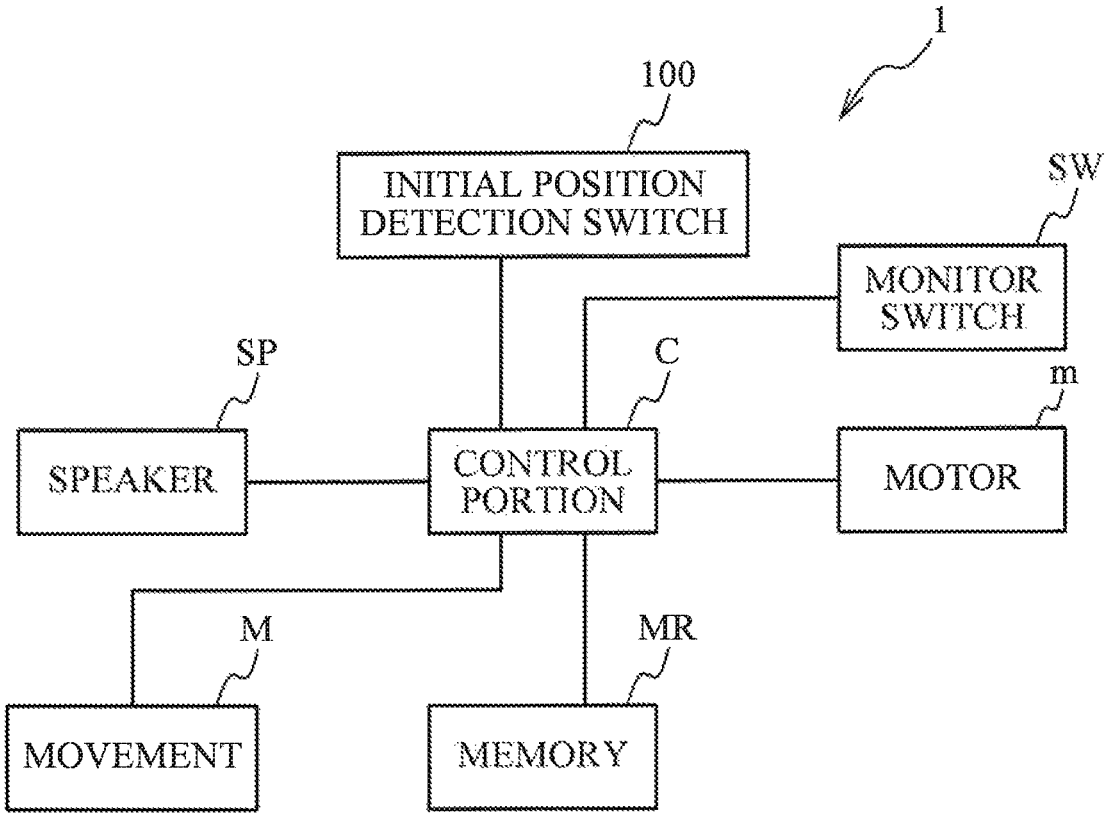
FIG. 9 is a functional block diagram of the timepiece.

FIG. 9 is a functional block diagram of the timepiece 1. The timepiece 1 includes a control portion C electrically connected with the motor m, the movement M, a speaker SP, a monitor switch SW, a memory MR, the initial position detection switch 100, and the like. The control portion C includes a ROM, a RAM, and a CPU, and controls the whole operation of the timepiece 1. The control portion C can recognize whether or not the ornamental body 10, the rotary board 80, and the like are positioned at the respective initial positrons, on the basis of a change in an output signal from the initial position detection switch 100. The speaker SP is an example of an output portion capable of outputting a sound.

Next, a performance operation will be described below. Under the movement control, a piece of theme music is selected from plural pieces of theme music and is output from the speaker SP, and the ornamental board 5, the ornamental body 10, and the like are moved based on a movement pattern associated with the selected piece of theme music. FIG. 10A is a schematic view of the pieces of theme music to be output and the movement patterns for the ornamental body 10 and the like under the movement control. The memory MR stores data of the first to sixth pieces of theme music capable of being output from the speaker SP, and stores data of the first to sixth movement patterns respectively associated with the first to sixth pieces of theme music. The memory MR is an example of a storing portion. The first to sixth movement patterns are provided for the ornamental board 5, the ornamental body 10, and the like.

These first to sixth movement patterns have different performance periods, different timings of temporary stop of the motor m, different periods of temporary stop of the motor m, and different timings of changing the rotational direction. The control portion C selects any one of the first to sixth pieces of theme music, outputs the selected piece of theme music from the speaker SP, and controls the rotation of the motor m based on the movement patterns associated with the selected piece of theme music. Thus, the ornamental body 10 and the like rotate in correspondence with the piece of theme music output from the speaker SP. For example, whenever the current time is twelve clock, one of the first to sixth pieces of theme music is selected in this order, and the ornamental body 10 and the like are moved based, on the movement pattern associated with the selected piece of theme music. In such a way, the ornamental body 10 and the like are moved in correspondence with the selected piece of theme music. This presents a wide variety of appearances. Additionally, the motor m has a constant rotational speed regardless of the rotational direction. However, the rotational speed may be changed depending on the movement pattern.

Under the return control, the control portion C controls the motor m to rotate reversely, so the ornamental body 10 and the like return to the respective initial positions. FIG. 10B is a schematic view of pieces of ending music to be output and the movement patterns for the ornamental body 10 and the like under the return control. The return control outputs one of the first and second pieces of ending music having different performance periods. Also, the data of the first and second pieces of ending music are stored in the memory MR. Additionally, in the present embodiment, the performance period of the first piece of ending music is shorter than that of the second piece of ending music.

Here, each of stop positions of the ornamental body 10 and the like at the end of the movement control is different depending on the movement pattern selected under the movement control. In other words, when the ornamental body 10 and the like are returned to the respective initial positions from the respective stop positions at the end of the movement control, the movement distance thereof is different depending on the movement pattern. Since the motor m has a constant rotational speed, the period required to return the ornamental body 10 and the like to the respective stop positions is also different. The control portion C performs the return control to select and output any one of the first and second pieces of ending music from the speaker SP, depending on the stop positions of the ornamental body 10 and the like at the end of the movement control period. This suppresses the timing when the piece of ending music is finished from being deviated from the timing when the ornamental body 10 and the like reach the respective initial positions. Additionally, the first and second, pieces of ending music have only to have different performance periods, and may be or not may be the same music.

Further, the control portion C estimates the stop positions of the ornamental body 10 and the like at the end of the movement control period as follows. The control portion C estimates the stop positions of the ornamental body 10 and the like, on the basis of an energization period of the motor m from the time when the ornamental body 10 and the like start moving from the respective initial positions to the time when the movement control is finished. Specifically, for example, the count value is counted up while the motor m is energized to rotate forward, and the count value is counted down while the motor in is energized to rotate reversely. The movement distance of the ornamental body 10 and the like from the respective initial positions is estimated, assuming that the energization is performed for a period corresponding to the count value at the end of the performance. Therefore, the control portion C can recognize the positions of the ornamental body 10 and the like. Also, in a case where the motor m rotate forward, the ornamental board 5, the ornamental body 10, and the like rotate clockwise when the timepiece 1 is viewed, from its front side. Further, the control portion C starts counting up the energization period of the motor m, when the initial position detection switch 100 detects that the ornamental body 10 and the like move from the respective initial positions.

Also, when the monitor switch SW is operated under the movement control, the timepiece 1 performs the monitor control. The monitor switch SW is an example of a monitor operation portion. Under the monitor control, a piece of theme music, different from the piece of theme music output under the movement control, is selected from the first to sixth pieces of theme music and is output from the speaker SP, and the ornamental body 10 and the like are moved based on a monitor movement pattern different from the first to sixth movement patterns. A user operates the monitor switch SW to grasp what kind of piece of theme music which the timepiece 1 is capable of outputting. This will be described later in detail.

Additionally, the monitor switch SW is operated in the initial state, so the above movement control is performed. The monitor switch SW is operated under the movement control, so the monitor control is performed.

Figure 11:
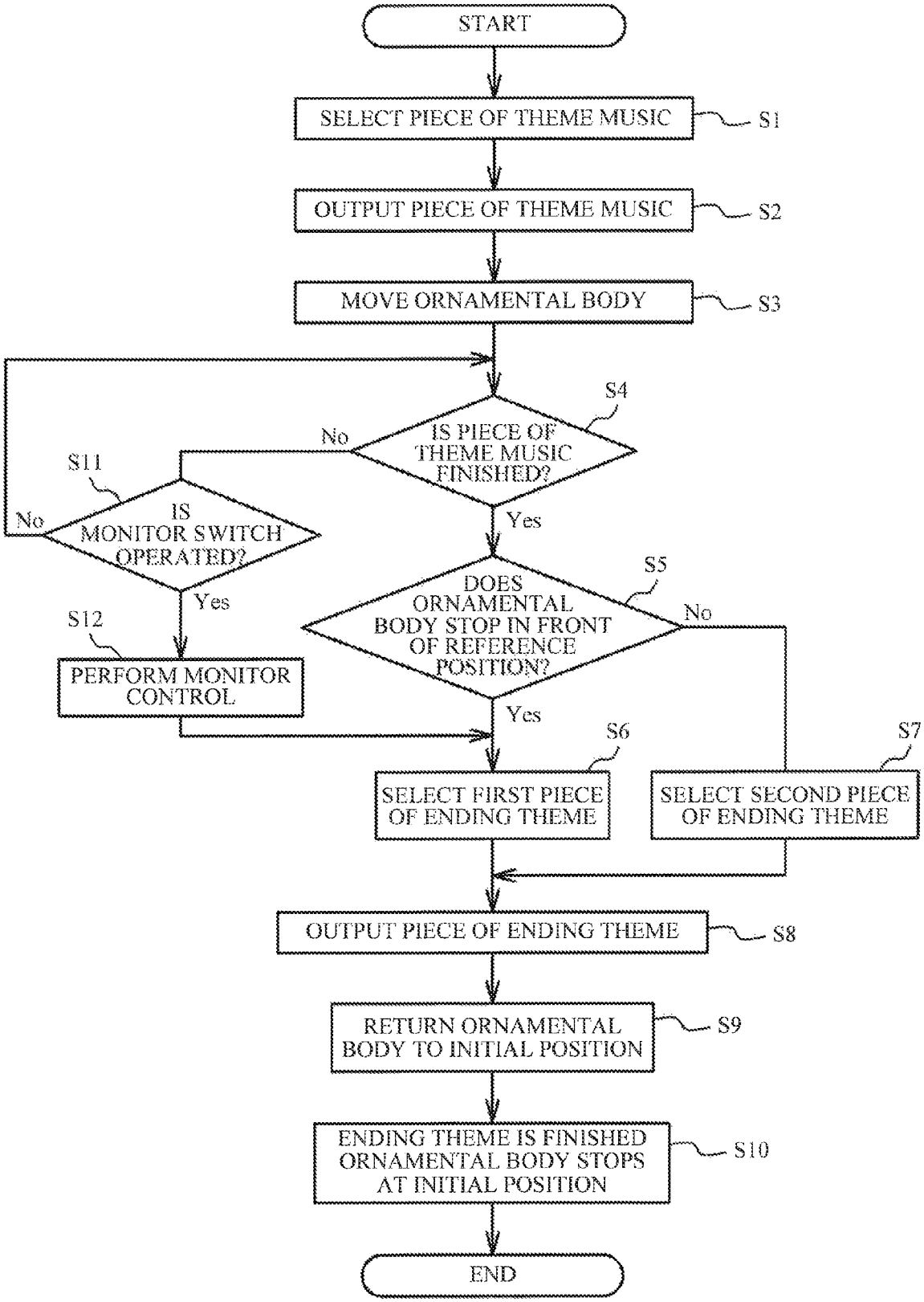
FIG. 11 is a flowchart of an example of control performed by a control portion.

FIG. 11 is a flow chart of an example of the control performed by the control portion C. A time when the performance movement starts has come, or the monitor switch SW is operated, so the control portion C performs the movement control. That is, a piece of theme music is selected from the first to sixth pieces of theme music (step S1), and the selected piece of theme music is output from the speaker SP (step S2). Next, the control portion C controls the ornamental board 5, the ornamental body 10, and the like to move based on the movement pattern associated with the selected piece of theme music (step S3).

The control portion C determines whether or not the piece of theme music is finished (step S4). When the piece of theme music is finished (step S4: Yes), the return control is performed as follows. The control portion C estimates the stop positions of the ornamental body 10 and the like on the basis of the energization period of the motor m, and determines whether or not the estimated stop positions are in front of respective reference positions (step S5). Herein, the reference positions are illustrated in FIG. 3. That is, the reference positions are where the rotary board 80 has rotated about a half turn. In addition, the reference positions are not limited, to these ones.

When affirmative determination is made in step S5, that is, when the ornamental body 10 and the like stop in front of the respective reference positions, the control portion C selects the first piece of ending music having a short performance period (step S6). For example, when the movement control is finished in a state illustrated in FIG. 2, the first piece of ending music is selected. Thus, when the stop position of the ornamental body 10 is close to the initial position, the first piece of ending music having a snort performance period is selected. When negative determination is made in step S5, that is, when the ornamental body 10 and the like stop beyond the respective reference positions, the control portion C selects the second piece of ending music having a long performance period (step S7). For example, when the movement control is finished in a state illustrated in FIG. 4, the second piece of ending music is selected. In such a way, when the stop position of the ornamental body 10 is distant away from the initial position, the second piece of ending music having a long performance period is selected.

The control portion C controls the speaker SP to output the selected piece of ending music (step S8), and controls the ornamental, body 10 and the like to return to the respective initial positions (step S9). After that, the piece of ending music is finished, and the ornamental body 10 and the like also stop at the respective initial positions (step S10). Moreover, the control portion C can determine whether or not the ornamental body 10 and the like return back to the respective initial positions on the basis of a change in an output signal from the initial position detection switch 100. When the ornamental body 10 and the like reach the respective initial positions, the control portion C controls the motor m to stop. This suppresses the timing when the piece of ending music is finished from being deviated from the timing when the ornamental body 10 and the like reach the respective initial positions under the return control. It is therefore possible to design the movement pattern of the ornamental body under the movement control, without consideration of the stop positions of the ornamental body 10 and the like at the end of the movement control period. This presents a wide variety of appearances of the timepiece 1.

When negative determination is made in step S4, that is, when the piece of theme music is output under the movement control, the control portion C determines whether or not the monitor switch SW is pushed (step S11). When negative determination is made, the control portion C performs the process of step S4 again. When affirmative determination is made, the control portion C performs the monitor control (step S12).

Under the monitor control, the control portion C selects the piece of theme music, different from the piece of theme music selected and output under the movement control, from the first to sixth pieces of theme music. The control portion C controls the speaker SP to output the piece of theme music. Also, the control portion C controls the ornamental body 10 and the like to move based on the monitor movement pattern, different from the movement pattern beforehand associated with, the currently selected piece of theme music. Specifically, the control portion C controls the rotation of the motor m such that the ornamental body 10 reciprocates in a predetermined range, as serving the position illustrated in FIG. 3 as a reference for determination.

For example, in a case where the monitor switch SW is pushed under the movement control and the ornamental body 10 and the like are moved based on the movement pattern beforehand associated with the currently selected piece of theme music, the following problem might occur. The first to sixth movement patterns are designed, provided that the ornamental body 10 and the like start moving from the respective initial positions. While the movement control is performed, the ornamental body 10 and the like have already been moved from the respective initial positions. In a case where the ornamental body 10 and the like are moved from positions other than the respective initial positions on the basis of any one of the first to sixth movement patterns, the rotary board 80 might rotate about one turn and the stopper 78 might restrict the rotation of the rotary board 80. When the rotation of the rotary board 80 is restricted and stopped, the ornamental body 10 and the like are stopped. This might cause deterioration of appearances.

In the present embodiment, the rotational direction of the ornamental body 10 and the like are determined, depending on the positions thereof at the time when the monitor switch SW is pushed under the movement control. In other words, for example, when the monitor switch SW is pushed in the state illustrated in FIG. 4 after the ornamental body 10 rotates beyond the reference position illustrated in FIG. 3, the ornamental body 10 and the like are returned toward the respective reference positions illustrated in FIG. 3. Also, when the monitor switch SW is pushed in the state where the ornamental body 10 and the like do not reach the respective reference positions, the ornamental body 10 and the like are kept moved toward the respective reference positions. In any cases, the ornamental body 10 and the like are moved in a predetermined movable range. For example, a predetermined movable range is a range, where the ornamental body 10 and the like are capable of moving for six seconds. After being moved in a predetermined movable range, the ornamental body 10 and the like are moved reversely in the same movable range. In other words, the ornamental body 10 and the like are moved reversely just for six seconds. Thus, the ornamental body 10 and the like are returned to the positions where they are located at the time when the monitor switch SW is pushed. After that, the reciprocation is repeated, until the performance of the selected piece of theme music is finished. In such a way, the ornamental body 10 and the like reciprocate in a predetermined range with respect to the respective references positions illustrated in FIG. 3. This prevents the stop of the ornamental board 5, the ornamental body 10, and the like caused by moving the ornamental board 5, the ornamental body 10, and the like to reach the position to restrict their movements. This suppresses deterioration of appearances.

Also, as for the reciprocation of the ornamental body 10 and the like under the monitor control, the control portion C always monitors the positions of the ornamental body 10 and the like on the basis of the energization period of the motor m as mentioned, above, and the control portion C causes the ornamental body 10 and the like to reciprocate on the basis of the positional relationship between the reference position and the position of the ornamental body 10 as mentioned above.

When the piece of theme music currently selected under the monitor is finished, the control portion C estimates the positions of the ornamental body 10 and the like, and determines whether or not they pass beyond the respective reference positions illustrated in FIG. 3. For example, when it is determined that they do not pass beyond the respective reference positions as illustrated in FIG. 3, the first piece of ending music having a short performance period is selected, and then the return control is performed (step S6). When it is determined that the ornamental body 10 and the like pass beyond the respective reference positions as illustrated in FIG. 3, for example, when it is determined that they are positioned as illustrated in FIG. 4, the second piece of ending music having a long performance period is selected, and then the return control is performed (step S7).

Further, when the monitor switch SW is operated again under the monitor control, the other piece of theme music is selected again, and then the ornamental board 5, the ornamental body 10, and the like are moved based on the monitor movement pattern.

While the exemplary embodiments of the present invention have been illustrated in detail, the present invention is not limited to the above-mentioned embodiments, and other embodiments, variations and modifications may be made without departing from the scope of the present invention.

Additionally, whether or not the ornamental body 10 and the like are positioned at the respective reference positions may be detected by, for example, a switch with which at least one of the ornamental board 5, the ornamental bodies 10, 30, and 50, and the rotary board 80 comes into contact.

Also, a photo-interrupter or a photo-reflector may detect whether or not the ornamental body 10 and the like are positioned at the respective reference positions. In a case of providing the photo-interrupter, for example, a light emitting element and a light receiving element may be arranged to sandwich the rotary board 80, the rotary board 80 may be formed with a through hole, and the light receiving element may receive light emitted from the light emitting element through the through hole when the rotary board 80 is positioned at its reference position. In a case of providing the photo-reflector, a light emitting element and a light receiving element may be arranged in one side of the rotary board 80, a reflector plate may be stuck on a part of the rotary board 80, and the light receiving element may receive light reflected by the reflector plate and emitted from the light emitting element when the rotary board 80 arrives at its reference position.

When the motor m is a stepping motor, the positions of the ornamental body 10 and the like may be estimated by counting the number of drive pulses applied to the motor m.

There may be two or more reference positions, and there may be three or more pieces of ending music. For example, the first reference position may be set close to the initial position, and the second reference position may be set away from, the initial position. Moreover, the first piece of ending music having the shortest performance period, the second piece of ending music having a performance period longer than the first piece of ending music, and the third piece of ending music having the longest performance period may be stored. In this case, for example, when the stop positions of the ornamental body 10 and the like at the end of the movement control are in front of the respective first reference positions, the first piece of ending music may be output. When the stop positions of the ornamental body 10 and the like at the end of the movement control are in front of the respective second reference and beyond the respective first reference positions, the second piece of ending music may be output. When the stop positions of the ornamental body 10 and the like at the end of the movement control are beyond the respective second reference positions, the third piece of ending music may be output.

The ornamental body is not limited to being composed of a dial plate.

What is claimed is:

1. A timepiece, comprising:

an ornamental body;

a drive mechanism moving the ornamental body;

an output portion capable of outputting a sound; and a control portion performing movement control for outputting a piece of theme music and moving the ornamental body from an initial position, and performing return control for outputting a piece of ending music and moving the ornamental body to the initial position after the movement control is finished, wherein plural types of pieces of theme music capable of being output from the output portion are respectively associated with plural types of movement patterns of the ornamental body, under the movement control, a piece of theme music selected from the plural types of pieces of theme music is output, and the ornamental body is moved based on a movement pattern associated with the selected piece of theme music, and under the return control, a piece of ending music is selected from plural pieces of ending music having different lengths and the piece of ending music is output, wherein the particular piece of ending music is selected based on whether a stop position of the ornamental body is beyond a reference position.

2. The timepiece of claim 1, wherein under the return control, when the stop position of the ornamental body at the end of the movement control is not beyond the reference position, a piece of ending music having a comparatively short performance period is output, and under the return control, when the stop position of the ornamental body at the end of the movement control is beyond the reference position, a piece of ending music having a comparatively long performance period is output.

3. The timepiece of claim 1, wherein the drive mechanism includes a motor, the control portion estimates the stop position based on an energization period, of the motor, while the ornamental body is being moved from the initial position to the stop position under the movement control, and the control portion selects a piece of ending music from the plural pieces of ending music depending on whether or not the estimated stop position is beyond the reference position.

4. The timepiece of claim 1, further comprising a detection portion detecting that the ornamental body is in the initial position.

* * * * *